US009857754B1

(12) United States Patent
Shingu

(10) Patent No.: US 9,857,754 B1
(45) Date of Patent: Jan. 2, 2018

(54) ELECTROPHOTOGRAPHIC PHOTORECEPTOR, PROCESS CARTRIDGE, AND IMAGE-FORMING APPARATUS

(71) Applicant: FUJI XEROX CO., LTD., Tokyo (JP)

(72) Inventor: Kenta Shingu, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/446,740

(22) Filed: Mar. 1, 2017

(30) Foreign Application Priority Data

Sep. 20, 2016 (JP) ..... 2016-183035

(51) Int. Cl.
*G03G 15/00* (2006.01)
*G03G 5/043* (2006.01)

(52) U.S. Cl.
CPC ..... *G03G 15/751* (2013.01); *G03G 5/043* (2013.01); *G03G 2215/00957* (2013.01)

(58) Field of Classification Search
CPC ..... G03G 5/043; G03G 15/75; G03G 15/751; G03G 2215/00957; G03G 2215/00962
USPC ..... 399/116, 159
See application file for complete search history.

(56) References Cited

U.S. PATENT DOCUMENTS

| | | | | |
|---|---|---|---|---|
| 5,298,617 A | | 3/1994 | Nukada et al. | |
| 5,302,479 A | | 4/1994 | Daimon et al. | |
| 5,459,004 A | | 10/1995 | Daimon et al. | |
| 6,541,172 B2 | * | 4/2003 | Nagasaka | G03G 5/047 399/174 |
| 6,656,652 B2 | * | 12/2003 | Ishii | G03G 5/047 399/116 |
| 8,247,143 B2 | * | 8/2012 | Egawa | G03G 5/075 399/159 |
| 2004/0053151 A1 | * | 3/2004 | Hashimoto | G03G 5/10 430/69 |
| 2016/0187792 A1 | * | 6/2016 | Toriu | G03G 5/04 399/159 |

FOREIGN PATENT DOCUMENTS

| | | | |
|---|---|---|---|
| EP | 0 710 893 A1 | | 5/1996 |
| JP | 4-189873 A | | 7/1992 |
| JP | 5-098181 A | | 4/1993 |
| JP | 5-140472 A | | 6/1993 |
| JP | 5-140473 A | | 6/1993 |
| JP | 5-263007 A | | 10/1993 |
| JP | 5-279591 A | | 10/1993 |
| JP | 8-176293 A | | 7/1996 |
| JP | 8-208820 A | | 8/1996 |
| JP | 11102080 A | * | 4/1999 |
| JP | 2004-078147 A | | 3/2004 |
| JP | 2005-181992 A | | 7/2005 |
| JP | 2005275395 A | * | 10/2005 |

(Continued)

*Primary Examiner* — Robert Beatty
(74) *Attorney, Agent, or Firm* — Sughrue Mion, PLLC

(57) ABSTRACT

An electrophotographic photoreceptor includes a conductive support including a surface having an arithmetic average roughness $Ra_1$ of 0.3 μm or more and 1.0 μm or less, an average length RSm of a roughness profile curve element of the surface in an axial direction of the conductive support being 400 μm or less, and a photosensitive layer disposed on the conductive support, the photosensitive layer including a surface having an arithmetic average roughness $Ra_2$ of 0.05 μm or more and 0.8 μm or less.

12 Claims, 5 Drawing Sheets

(56) References Cited

FOREIGN PATENT DOCUMENTS

| | | | | |
|---|---|---|---|---|
| JP | 2006-337756 | A | | 12/2006 |
| JP | 2009031342 | A | * | 2/2009 |
| JP | 2009031418 | A | * | 2/2009 |
| JP | 2012-155282 | A | | 8/2012 |

* cited by examiner

ELECTROPHOTOGRAPHIC PHOTORECEPTOR, PROCESS CARTRIDGE, AND IMAGE-FORMING APPARATUS

CROSS-REFERENCE TO RELATED APPLICATIONS

This application is based on and claims priority under 35 USC 119 from Japanese Patent Application No. 2016-183035 filed Sep. 20, 2016.

BACKGROUND

(i) Technical Field

The present invention relates to an electrophotographic photoreceptor, a process cartridge, and an image-forming apparatus.

(ii) Related Art

In electrophotographic image-forming apparatuses widely known in the related art, the steps of charging, exposure, development, transfer, cleaning, and the like are sequentially conducted using an electrophotographic photoreceptor.

Known examples of the electrophotographic photoreceptor include a separated-function photoreceptor that includes a charge-generating layer that generates charge upon being irradiated with light and a charge-transporting layer that transports the charge which are stacked on a conductive support made of aluminum or the like; and a single-layer photoreceptor that generates charge and transports the charge by using the same layer.

A known example of a method for producing the conductive support included in an electrophotographic photoreceptor is a method in which a cylindrical pipe is formed by extruding followed by drawing and the outer periphery of the cylindrical pipe is ground in order to adjust the thickness, surface roughness, and the like of the cylindrical pipe.

Another example of a method for producing the conductive support included in an electrophotographic photoreceptor is impact pressing in which an impact is given, with a male die, to a slug placed in a female die such that the slug is formed into a cylinder, which is a method for producing thin-walled metal containers and the like at low costs.

SUMMARY

According to an aspect of the invention, there is provided an electrophotographic photoreceptor including a conductive support including a surface having an arithmetic average roughness $Ra_1$ of 0.3 μm or more and 1.0 μm or less, an average length RSm of a roughness profile curve element of the surface in an axial direction of the conductive support being 400 μm or less; and a photosensitive layer disposed on the conductive support, the photosensitive layer including a surface having an arithmetic average roughness $Ra_2$ of 0.05 μm or more and 0.8 μm or less.

BRIEF DESCRIPTION OF THE DRAWINGS

Exemplary embodiments of the present invention will be described in detail based on the following figures, wherein.

DETAILED DESCRIPTION

Figure 1:
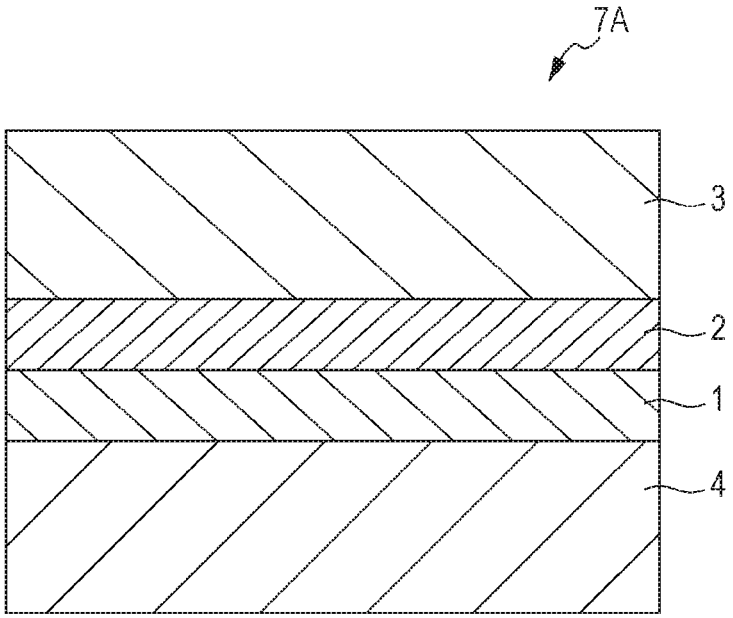
FIG. 1 is a schematic cross-sectional view of an example of an electrophotographic photoreceptor according to an exemplary embodiment.

Exemplary embodiments of the invention are described below.

Electrophotographic Photoreceptor

An electrophotographic photoreceptor (hereinafter, referred to simply as "photoreceptor") according to an exemplary embodiment includes a conductive support including a surface having an arithmetic average roughness $Ra_1$ of 0.3 μm or more and 1.0 μm or less, the average length RSm of a roughness profile curve element of the surface in the axial direction being 400 μm or less; and a photosensitive layer disposed on the conductive support, the photosensitive layer including a surface having an arithmetic average roughness $Ra_2$ of 0.05 μm or more and 0.8 μm or less.

The above-described photoreceptor according to this exemplary embodiment may reduce the occurrence of minute line defects, for example, having a width of 2 mm or less and a length of 30 mm or less, which are likely to occur when contact charging in which only a direct voltage is applied to the photoreceptor is employed. Furthermore, the occurrence of color spots (e.g., black spots) may also be reduced.

Charging devices (examples of a charging unit) are roughly classified into two groups: contact charging devices that charge a photoreceptor by coming into direct contact with the photoreceptor; and non-contact charging devices that charge a photoreceptor by using a corona discharge or the like in the vicinity of the photoreceptor instead of coming into contact with the photoreceptor.

It is desirable to employ contact charging because non-contact charging devices may create byproducts such as ozone and nitrogen oxides when discharging is performed.

Contact charging methods are further classified into two groups: a charging method in which only a direct voltage is applied to a photoreceptor (hereinafter, this charging method is referred to as "DC contact charging"); and a charging method in which a voltage consisting of an alternating voltage superimposed on a direct voltage is applied to a photoreceptor (hereinafter, this charging method is referred to as "AC/DC contact charging"). In AC/DC contact charging, a high load is placed on a photoreceptor due to a relatively high charging potential of AC/DC contact charging. This may result in the abrasion of a photosensitive layer included in the photoreceptor. Accordingly, it is known that DC contact charging is more suitable for long-term use. In addition, DC contact charging consumes less power. Thus, it is desirable that an electrophotographic image-forming apparatus employs DC contact charging in consideration of the maintenance cost.

However, when a photoreceptor is charged by DC contact charging, unwanted, minute line defects may occur in images. Moreover, color spots may be formed in the images.

When a photoreceptor is charged by DC contact charging, for example, the electric field may be locally concentrated at protrusions formed in the surface of a conductive support included in the photoreceptor. This may result in an inconsistency in the amount of charge on the photoreceptor. The inconsistency in the amount of charge on the photoreceptor may also be caused due to the nonuniformity in the thickness of the photosensitive layer. This is presumably because, when, for example, a region of the photosensitive layer in which the thickness of the photosensitive layer is excessively small is present, the electric field is likely to be applied to (i.e., concentrated at) the region during the charging of the photoreceptor.

It is considered that the minute line defects are caused due to the inconsistency in the amount of charge on the photoreceptor which results from the local concentration of the electric field in a conductive support or the concentration of the electric field at regions of a photosensitive layer in which the thickness of the photosensitive layer is excessively small. The above-described concentration of the electric field may lead to the leakage of charge. This increases the occurrence of color spots.

It is considered that, in general, the inconsistency in the amount of charge on the photoreceptor is more likely to occur in the case where DC contact charging is employed than in the case where AC/DC contact charging is employed because DC contact charging is less likely to achieve a uniform-charging property.

Accordingly, the photoreceptor according to this exemplary embodiment includes a conductive support including a surface having an arithmetic average roughness $Ra_1$ that falls within the above range, the average length RSm of a roughness profile curve element of the surface in the axial direction falling the above range, and a photosensitive layer including a surface having an arithmetic average roughness $Ra_2$ that falls within the above range in a combined manner. This may reduce the occurrence of the minute line defects which are likely to occur when contact charging in which only a direct voltage is applied to the photoreceptor, that is, DC contact charging, is employed. In addition, the occurrence of color spots may be reduced. Although the reasons for this are not known, the following is considered.

Setting the arithmetic average roughness $Ra_1$ of the conductive support (hereinafter, referred to simply as "arithmetic average roughness $Ra_1$") to fall within the above range means that the degree of irregularity of the surface of the conductive support is relatively small.

Setting the average length RSm of the conductive support (hereinafter, referred to simply as "average length RSm") to fall within the above range means that protrusions and grooves are formed in the surface of the conductive support in a relatively short cycle in the axial direction.

Setting the arithmetic average roughness $Ra_2$ of the photosensitive layer (hereinafter, referred to simply as "arithmetic average roughness $Ra_2$") to fall within the above range means that the degree of irregularity of the surface of the photosensitive layer is relatively small.

It is considered that relatively short waves are present periodically in the surface of a conductive support having an arithmetic average roughness $Ra_1$ and an average length RSm that fall within the respective ranges described above. Therefore, for example, even when the electric field is concentrated at the protrusions of the surface of the conductive support, the concentration of the electric field is considered to be substantially uniform over the surface of the conductive support along the relatively short waves of the surface. That is, the concentration of the electric field is considered to be reduced on the whole. This reduces the inconsistency in the amount of charge on the photoreceptor which is caused due to the local concentration of an electric field in the conductive support.

When the arithmetic average roughness $Ra_1$ and the arithmetic average roughness $Ra_2$ fall within the respective ranges described above, the conductive support and the photosensitive layer both have a smooth surface. This reduces the nonuniformity in the thickness of the photosensitive layer. Specifically, the likelihood of regions of the photosensitive layer in which the thickness of the photosensitive layer is excessively small being present is reduced, and the distance between the surface of the photosensitive layer, that is, the surface of the photoreceptor, and the surface of the conductive support becomes substantially uniform. Consequently, the occurrence of concentration of the electric field at regions of the photosensitive layer in which the thickness of the photosensitive layer is excessively small is reduced, and the distribution of charge on the photosensitive layer is improved. As a result, the inconsistency in the amount of charge on the photoreceptor may be reduced.

As described above, the photoreceptor according to this exemplary embodiment may reduce the inconsistency in the amount of charge on the photoreceptor which results from the local concentration of the electric field in the conductive support or the concentration of the electric field at regions of the photosensitive layer in which the thickness of the photosensitive layer is excessively small. This may reduce the occurrence of the minute line defects.

Since the concentration of the electric field is reduced as described above, the occurrence of the leakage of charge may also be reduced. This may reduce the occurrence of color spots.

By the above-described mechanisms, the photoreceptor according to this exemplary embodiment may reduce the occurrence of minute line defects, for example, having a width of 2 mm or less and a length of 30 mm or less, which are likely to occur when DC contact charging is employed, and the occurrence of color spots (e.g., black spots).

The arithmetic average roughness $Ra_1$ and the average length RSm of the conductive support and the arithmetic average roughness $Ra_2$ of the photosensitive layer are described below more in detail.

Arithmetic Average Roughness $Ra_1$

In this exemplary embodiment, the arithmetic average roughness $Ra_1$ of the conductive support is the average of the absolute values of the heights of roughness curves having a specific reference length which is specified in JIS B0601 (2013) and measured with a surface-roughness tester "Surfcom" produced by TOKYO SEIMITSU CO., LTD.

The arithmetic average roughness $Ra_1$ may be 0.3 μm or more and 1.0 μm or less, is preferably 0.3 μm or more and 0.75 μm or less, and is more preferably 0.3 μm or more and 0.6 μm or less in order to reduce the occurrence of the minute line defects which are likely to occur when DC contact charging is employed and the occurrence of color spots. The lower limit of the arithmetic average roughness $Ra_1$ may be 0.3 μm in order to reduce the formation of interference fringes on the photoreceptor.

In the case where a photoreceptor including the conductive support is used in a laser printer, the laser emission wavelength may be 350 nm or more and 850 nm or less. The shorter the laser emission wavelength, the higher the resolution of the laser printer. In such a case, the surface of the conductive support may be roughened to 0.3 μm or more and 1.0 μm or less in terms of the arithmetic average roughness $Ra_1$ in order to reduce the likelihood of interference fringes occurring when the photoreceptor is irradiated with a laser beam. Setting the arithmetic average roughness $Ra_1$ to 0.3 μm or more enables the reduction in the occurrence of interference to be readily achieved. Setting the arithmetic average roughness $Ra_1$ to 1.0 μm or less reduces, with effect, the likelihood of the quality of images formed using a photoreceptor including the conductive support being degraded.

Average Length RSm of Roughness Profile Curve Element in Axial Direction

In this exemplary embodiment, the average length RSm of a roughness profile curve element of the conductive support in the axial direction is the average of the lengths of roughness profile curve elements having a specific reference length which is specified in JIS B0601 (2013) and measured with a surface-roughness tester "Surfcom" produced by TOKYO SEIMITSU CO., LTD.

The average length RSm may be 400 μm or less, is preferably 300 μm or less, and is more preferably 250 μm or less in order to reduce the occurrence of the minute line defects, which are likely to occur when DC contact charging is employed, and the occurrence of color spots.

Measurement of Arithmetic Average Roughness $Ra_1$ and Average Length RSm of Roughness Profile Curve Element in Axial Direction The arithmetic average roughness $Ra_1$ and the average length RSm in the axial direction are determined in the following manner.

A 40-mm region that extends from a position 10 mm from an end portion of the conductive support in the axial direction to a position 50 mm from the end portion and another 40-mm region that extends from a position 10 mm from the other end portion of the conductive support to a position 50 mm from the other end portion, that is, a 80-mm region in total, is scanned in the axial direction in order to measure the shape, that is, roughness profile curves, of the surface of the conductive support.

The following measurement conditions are employed in accordance with JIS B0601 (2013): evaluation length Ln: 4.0 mm, reference length L: 0.8 mm, and cut-off value: 0.8 mm. The surface of the conductive support is scanned in the axial direction 36 times in total at intervals of 10° in the circumferential direction.

The arithmetic average roughness $Ra_1$ is determined by calculating the "average of the absolute values of the heights of roughness profile curves" from the 36 roughness profile curves measured by the scanning.

The average length RSm in the axial direction is determined by calculating the "average of the lengths of roughness profile curve elements" from the 36 roughness profile curves measured by the scanning.

A method for controlling the arithmetic average roughness $Ra_1$ and the average length RSm to fall within the respective ranges described above is not limited; for example, etching, anodic oxidation, coarse grinding, centerless grinding, blasting such as sand blasting, and wet honing may be employed in order to roughen (i.e., form irregularities in) the surface of a cylindrical member, that is, a conductive support whose surface has not yet been roughened. Blasting may be employed for roughening the surface of the cylindrical member in order to control the arithmetic average roughness $Ra_1$ and the average length RSm to fall within the respective ranges described above. The above roughening methods may be used in combination of two or more.

Examples of the cylindrical member include a drawn pipe produced by drawing (i.e., original pipe or unmachined pipe); a machined pipe produced by grinding a drawn pipe; and an impact-pressed pipe produced by impact pressing. Among the above cylindrical members, in particular, a machined pipe may be used in order to control the arithmetic average roughness $Ra_1$ and the average length RSm to fall within the respective ranges described above.

The photoreceptor according to this exemplary embodiment includes a photosensitive layer disposed on the conductive support. In the photoreceptor according to this exemplary embodiment, the photosensitive layer serves as an outermost layer. The arithmetic average roughness $Ra_2$ of the surface of the photosensitive layer is 0.05 μm or more and 0.8 μm or less.

Arithmetic Average Roughness $Ra_2$

In this exemplary embodiment, the arithmetic average roughness $Ra_2$ of the photosensitive layer is the average of absolute values of the heights of roughness profile curves having a specific reference length which is specified in JIS B0601 (2013) and is measured with a surface-roughness tester "Surfcom" produced by TOKYO SEIMITSU CO., LTD.

The arithmetic average roughness $Ra_2$ may be 0.05 μm or more and 0.8 μm or less and is preferably 0.05 μm or more and 0.6 μm or less in order to reduce the occurrence of the minute line defects, which are likely to occur when DC contact charging is employed, and the occurrence of color spots. The lower limit of the arithmetic average roughness $Ra_2$ may be 0.05 μm in consideration of feasibility.

Measurement of Arithmetic Average Roughness $Ra_2$

The arithmetic average roughness $Ra_2$ may be determined in the following manner.

A piece is cut with a cutter or the like from the photosensitive layer that is to be measured. Thus, a measurement sample is prepared.

The measurement sample is subjected to the above-described surface-roughness tester "Surfcom" produced by TOKYO SEIMITSU CO., LTD. The following measurement conditions are employed in accordance with JIS B0601 (2013): evaluation length Ln: 4 mm, reference length L: 0.8 mm, and cut-off value: 0.8 mm.

A method for controlling the arithmetic average roughness $Ra_2$ to fall within the above range is not limited. In the case where the sublayers of the photosensitive layer, that is, the charge-generating layer, the charge-transporting layer, and a surface layer, are formed by dip coating, for example, the following methods may be employed: a method in which the viscosities (mPa·s) of coating liquids used for forming the respective sublayers are adjusted in the preparation of the coating liquids; and a method in which, in the formation of each of the coating films corresponding to the respective sublayers, the conductive support is dipped into a coating tank containing a coating liquid used for forming the coating film and subsequently withdrawn from the coating tank at an appropriate withdrawal rate (mm/min). The details of the above methods are described below. The arithmetic average roughness $Ra_2$ may be controlled by changing the properties of the surface of the conductive support, that is, the arithmetic average roughness $Ra_1$ and the average length RSm.

The electrophotographic photoreceptor according to this exemplary embodiment is described below in detail with reference to the attached drawings.

Figure 2:
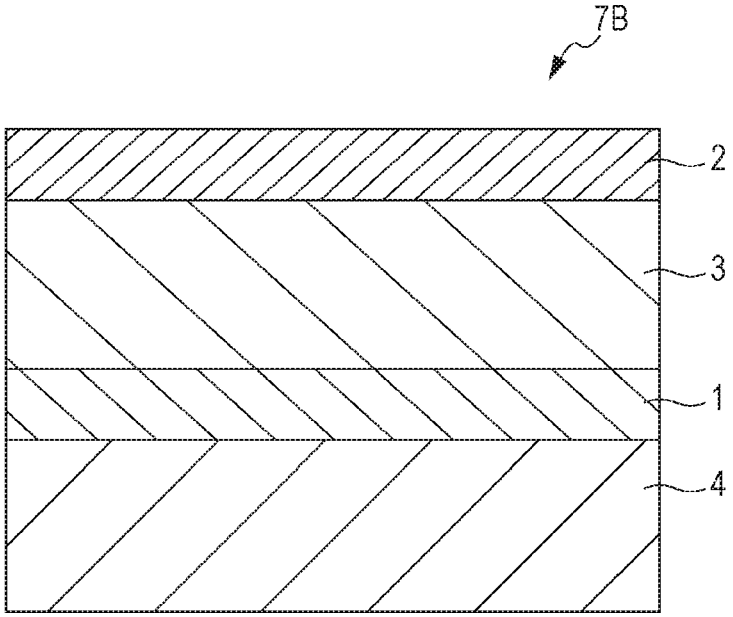
FIG. 2 is a schematic cross-sectional view of another example of an electrophotographic photoreceptor according to an exemplary embodiment.

FIG. 1 is a schematic cross-sectional view of an example of the electrophotographic photoreceptor according to this exemplary embodiment. FIG. 2 is a schematic cross-sectional view of another example of the electrophotographic photoreceptor according to this exemplary embodiment.

The electrophotographic photoreceptor 7A illustrated in FIG. 1 has a structure including a conductive support 4, an undercoat layer 1, a charge-generating layer 2, and a charge-transporting layer 3, which are stacked on top of one another in this order. The electrophotographic photoreceptor 7B illustrated in FIG. 2 has a structure including a conductive support 4, an undercoat layer 1, a charge-transporting layer 3, and a charge-generating layer 2, which are disposed on top of one another in this order.

The electrophotographic photoreceptors illustrated in FIGS. 1 and 2 are examples of a separated-function electrophotographic photoreceptor that includes a charge-generating layer and a charge-transporting layer that constitute a photosensitive layer.

In the electrophotographic photoreceptors 7A and 7B illustrated in FIGS. 1 and 2, respectively, the arithmetic average roughness $Ra_1$ and the average length RSm of the conductive support 4 and the arithmetic average roughness $Ra_2$ of the photosensitive layer, which is constituted by the charge-generating layer 2 and the charge-transporting layer 3, fall within the respective ranges described above.

The undercoat layer 1 is an optional layer. An intermediate layer may optionally be interposed between the undercoat layer 1 and the photosensitive layer, which is constituted by the charge-generating layer 2 and the charge-transporting layer 3.

Hereafter, the electrophotographic photoreceptor 7A illustrated in FIG. 1 is taken as a representative example, and the components thereof are each described. In the following description, reference numerals are omitted.

Conductive Support

Examples of the conductive support include a metal sheet, a metal drum (i.e., a metal cylinder), and a metal belt that include a metal such as aluminum, copper, zinc, chromium, nickel, molybdenum, vanadium, indium, gold, or platinum or an alloy such as stainless steel. Other examples of the conductive support include a paper sheet, a resin film, and a belt on which a conductive compound such as a conductive polymer or indium oxide, a metal such as aluminum, palladium, or gold, or an alloy is deposited by coating, vapor deposition, or lamination. The term "conductive" used herein refers to having a volume resistivity of less than $10^{13}$ Ωcm.

In this exemplary embodiment, the type of the conductive support is not limited, and any conductive support may be used as long as the arithmetic average roughness $Ra_1$ and the average length RSm of the conductive support can be controlled to fall within the respective ranges described above. A metal cylinder such as an unmachined pipe, a machined pipe, or an impact-pressed pipe may be used as a conductive support. In particular, a machined pipe may be used in order to control the arithmetic average roughness $Ra_1$ and the average length RSm to fall within the respective ranges described above.

In the case where the metal cylinder is an impact-pressed pipe, the metal cylinder may be composed primarily of aluminum. In other words, the metal cylinder may include aluminum such that the content of aluminum in the metal cylinder is more than 50% by weight.

In this exemplary embodiment, the thickness (i.e., radial thickness) of the conductive support is not limited. For example, in the case where the conductive support (i.e., the metal cylinder) is a machined pipe, the thickness of the conductive support is preferably 0.25 mm or more and 1.0 mm or less and is more preferably 0.25 mm or more and 0.75 mm or less in order to reduce the occurrence of the minute line defects, which are likely to occur when DC contact charging is employed, and the occurrence of color spots.

In the case where the conductive support is an impact-pressed pipe, the thickness of the conductive support is preferably 0.25 mm or more and 0.8 mm or less and is more preferably 0.4 mm or more and 0.7 mm or less in order to reduce the occurrence of the minute line defects, which are likely to occur when DC contact charging is employed, and the occurrence of color spots.

Method for Producing Conductive Support

In this exemplary embodiment, the conductive support is produced by, for example, roughening (i.e., forming irregularities in) the surface of a cylindrical member.

The type of the cylindrical member, such as an unmachined pipe, a machined pipe, or an impact-pressed pipe, is not limited and may be any cylindrical member produced in a known method. The cylindrical member may be a commercially-available one.

Roughening of Surface of Cylindrical Member

Figure 3:
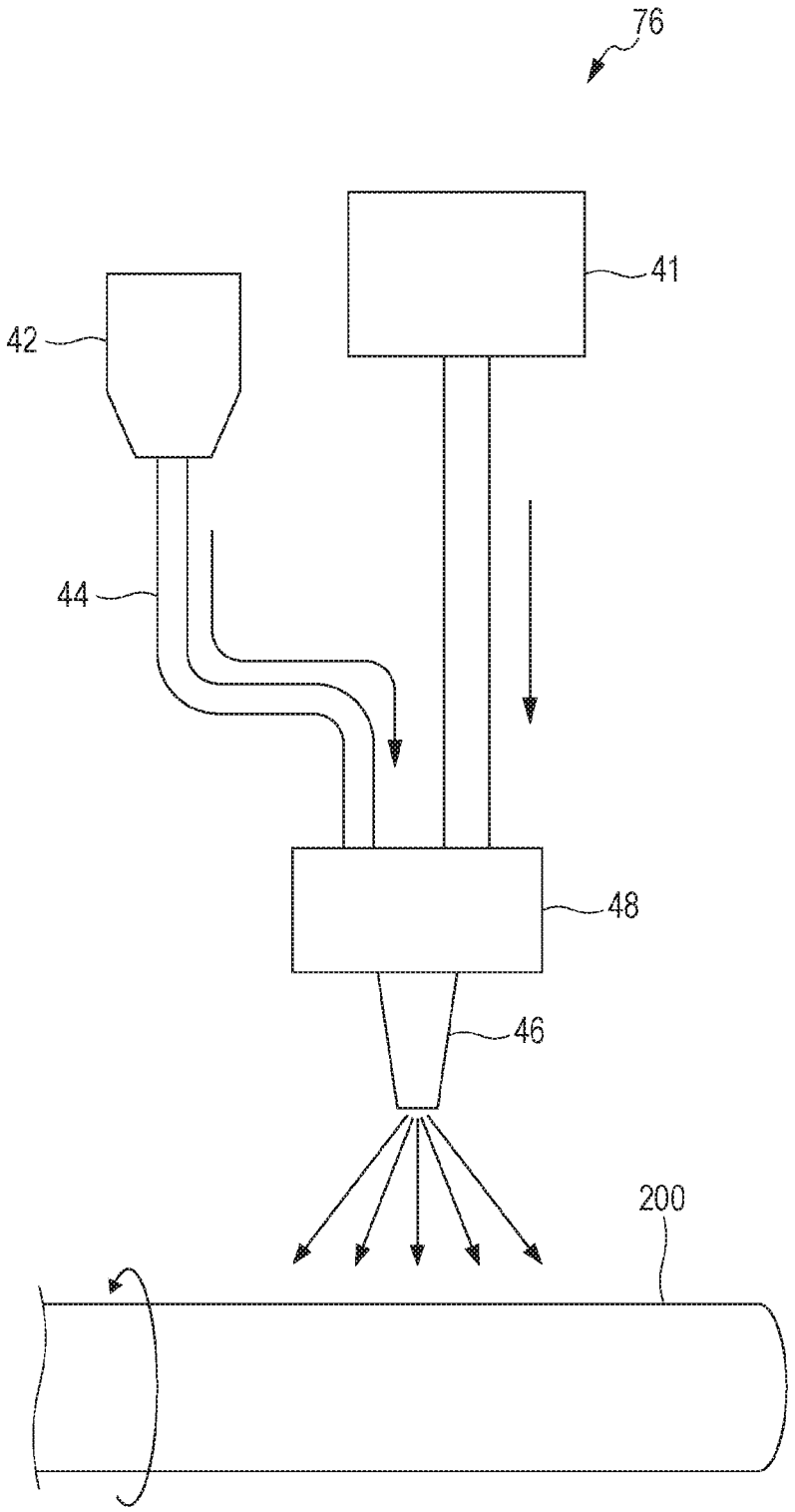
FIG. 3 is a diagram schematically illustrating a blasting machine used in an exemplary embodiment.

In this embodiment, a method for roughening the surface of the cylindrical member by blasting is described. FIG. 3 schematically illustrates a blasting machine. A blasting machine 76 used in this exemplary embodiment is a sand-blasting machine.

As illustrated in FIG. 3, the blasting machine 76 includes a compressor 41 that feeds compressed air; a tank 42 that stores an abrasive (not illustrated); a mixing section 48 in which the abrasive fed from the tank 42 through a feeding pipe 44 is mixed with the compressed air fed from the compressor 41; and a nozzle 46 through which the abrasive is ejected from the mixing section 48 with the compressed air and blown on a cylindrical member 200.

In the blasting treatment, an abrasive (not illustrated) stored in the tank 42 is fed to the mixing section 48 through the feeding pipe 44 and subsequently mixed with compressed air fed from the compressor 41 in the mixing section 48 as illustrated in FIG. 3. The abrasive is ejected from the mixing section 48 through the nozzle 46 with the compressed air and blown on the cylindrical member 200. As a result, the surface of the cylindrical member 200 is roughened. While the surface of the cylindrical member 200 is roughened, the cylindrical member 200 is rotated by a driving force transferred from a power source (not illustrated).

The abrasive is not limited, and any known abrasive may be used. Examples of known abrasives include metals such as stainless steel, iron, and zinc; ceramics such as zirconia, alumina, silica, and silicon carbide; and resins such as a polyamide and a polycarbonate.

The size of particles of the abrasive, the abrasive-irradiation pressure, and the abrasive-irradiation time may be set to fall within the respective ranges below in order to control the arithmetic average roughness $Ra_1$ and the average length RSm of the cylindrical member 200 to fall within the respective ranges. The term "abrasive-irradiation pressure" used herein refers to the pressure at which the abrasive is blown on the cylindrical member 200. The term "abrasive-irradiation time" used herein refers to the amount of time during which the abrasive is blown on the cylindrical member 200.

The size of particles of the abrasive is, for example, preferably 30 μm or more and 300 μm or less and is more preferably 60 μm or more and 250 μm or less.

The abrasive-irradiation pressure is, for example, preferably 0.1 MPa or more and 0.5 MPa or less and is more preferably 0.15 MPa or more and 0.4 MPa or less.

The abrasive-irradiation time is, for example, preferably 5 seconds or more and 60 seconds or less, is more preferably 5 seconds or more and 45 seconds or less, and is further preferably 10 seconds or more and 30 seconds or less.

The device used for feeding the compressed air is not limited. For example, a centrifugal blower may be used instead of the compressor 41. The compressed air is not necessarily used. A gas other than air may also be used as a medium for ejecting the abrasive.

Undercoat Layer

The undercoat layer includes, for example, inorganic particles and a binder resin.

The inorganic particles may have, for example, a powder resistivity (i.e., volume resistivity) of $10^2$ Ωcm or more and $10^{11}$ Ωcm or less.

Among such inorganic particles having the above resistivity, for example, metal oxide particles such as tin oxide particles, titanium oxide particles, zinc oxide particles, and zirconium oxide particles are preferable and zinc oxide particles are particularly preferable.

The BET specific surface area of the inorganic particles may be, for example, 10 $m^2/g$ or more.

The volume-average diameter of the inorganic particles may be, for example, 50 nm or more and 2,000 nm or less and is preferably 60 nm or more and 1,000 nm or less.

The content of the inorganic particles is preferably, for example, 10% by weight or more and 80% by weight or less and is more preferably 40% by weight or more and 80% by weight or less of the amount of binder resin.

The inorganic particles may optionally be subjected to a surface treatment. It is possible to use two or more types of inorganic particles which have been subjected to different surface treatments or have different diameters in a mixture.

Examples of an agent used in the surface treatment include a silane coupling agent, a titanate coupling agent, an aluminum coupling agent, and a surfactant. In particular, a silane coupling agent is preferable, and a silane coupling agent including an amino group is more preferable.

Examples of the silane coupling agent including an amino group include, but are not limited to, 3-aminopropyltriethoxysilane, N-2-(aminoethyl)-3-aminopropyltrimethoxysilane, N-2-(aminoethyl)-3-aminopropylmethyldimethoxysilane, and N,N-bis(2-hydroxyethyl)-3-aminopropyltriethoxysilane.

Two or more silane coupling agents may be used in a mixture. For example, a silane coupling agent including an amino group may be used in combination with another type of silane coupling agent. Examples of the other type of silane coupling agent include, but are not limited to, vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane.

A method for treating the surface of the inorganic particles with the surface-treating agent is not limited, and any known surface treatment method may be employed. Both dry process and wet process may be employed.

The amount of surface-treating agent used may be, for example, 0.5% by weight or more and 10% by weight or less of the amount of inorganic particles.

The undercoat layer may include an electron-accepting compound (i.e., acceptor compound) in addition to the inorganic particles in order to enhance the long-term stability of electrical properties and carrier-blocking property.

Examples of the electron-accepting compound include the following electron-transporting substances: quinones such as chloranil and bromanil; tetracyanoquinodimethanes; fluorenones such as 2,4,7-trinitrofluorenone and 2,4,5,7-tetranitro-9-fluorenone; oxadiazoles such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole; xanthones; thiophenes; and diphenoquinones such as 3,3',5,5'-tetra-t-butyldiphenoquinone.

In particular, compounds including an anthraquinone structure may be used as an electron-accepting compound. Examples of the compounds including an anthraquinone structure include hydroxyanthraquinones, aminoanthraquinones, and aminohydroxyanthraquinones. Specific examples thereof include anthraquinone, alizarin, quinizarin, anthrarufin, and purpurin.

The electron-accepting compound included in the undercoat layer may be dispersed in the undercoat layer together with the inorganic particles or deposited on the surfaces of the inorganic particles.

For depositing the electron-accepting compound on the surfaces of the inorganic particles, for example, a dry process or a wet process may be employed.

In a dry process, for example, while the inorganic particles are stirred with a mixer or the like capable of producing a large shearing force, the electron-accepting compound or a solution prepared by dissolving the electron-accepting compound in an organic solvent is added dropwise or sprayed together with dry air or a nitrogen gas to the inorganic particles in order to deposit the electron-accepting compound on the surfaces of the inorganic particles. The addition or spraying of the electron-accepting compound may be done at a temperature equal to or lower than the boiling point of the solvent used. Subsequent to the addition or spraying of the electron-accepting compound, the resulting inorganic particles may optionally be baked at 100° C. or more. The temperature at which the inorganic particles are baked and the amount of time during which the inorganic particles are baked are not limited; the inorganic particles may be baked under appropriate conditions of temperature and time under which the intended electrophotographic properties are achieved.

In a wet process, for example, while the inorganic particles are dispersed in a solvent with a stirrer, an ultrasonic wave, a sand mill, an Attritor, a ball mill, or the like, the electron-accepting compound is added to the dispersion liquid. After the resulting mixture has been stirred or dispersed, the solvent is removed such that the electron-accepting compound is deposited on the surfaces of the inorganic particles. The removal of the solvent may be done by, for example, filtration or distillation. Subsequent to the removal of the solvent, the resulting inorganic particles may optionally be baked at 100° C. or more. The temperature at which the inorganic particles are baked and the amount of time during which the inorganic particles are baked are not limited; the inorganic particles may be baked under appropriate conditions of temperature and time under which the intended electrophotographic properties are achieved. In the wet process, moisture contained in the inorganic particles may be removed prior to the addition of the electron-accepting compound. The removal of moisture contained in the inorganic particles may be done by, for example, heating the inorganic particles while being stirred in the solvent or by bringing the moisture to the boil together with the solvent.

The deposition of the electron-accepting compound may be done prior or subsequent to the surface treatment of the inorganic particles with the surface-treating agent. Alternatively, the deposition of the electron-accepting compound and the surface treatment using the surface-treating agent may be performed at the same time.

The content of the electron-accepting compound may be, for example, 0.01% by weight or more and 20% by weight or less and is preferably 0.01% by weight or more and 10% by weight or less of the amount of inorganic particles.

Examples of the binder resin included in the undercoat layer include the following known materials: known high-molecular compounds such as an acetal resin (e.g., polyvinyl butyral), a polyvinyl alcohol resin, a polyvinyl acetal resin, a casein resin, a polyamide resin, a cellulose resin, gelatin, a polyurethane resin, a polyester resin, an unsaturated polyester resin, a methacrylic resin, an acrylic resin, a polyvinyl chloride resin, a polyvinyl acetate resin, a vinyl chloride-vinyl acetate-maleic anhydride resin, a silicone resin, a silicone-alkyd resin, a urea resin, a phenolic resin, a phenol-formaldehyde resin, a melamine resin, a urethane resin, an alkyd resin, and an epoxy resin; zirconium chelates; titanium chelates; aluminum chelates; titanium alkoxides; organic titanium compounds; and silane coupling agents.

Other examples of the binder resin included in the undercoat layer include charge-transporting resins including a charge-transporting group and conductive resins such as polyaniline.

Among the above binder resins, a resin insoluble in a solvent included in a coating liquid used for forming a layer on the undercoat layer may be used as a binder resin included in the undercoat layer. In particular, resins produced by reacting at least one resin selected from the group consisting of thermosetting resins (e.g., a urea resin, a phenolic resin, a phenol-formaldehyde resin, a melamine resin, a urethane resin, an unsaturated polyester resin, an alkyd resin, and an epoxy resin), polyamide resins, polyester resins, polyether resins, methacrylic resins, acrylic resins, polyvinyl alcohol resins, and polyvinyl acetal resins with a curing agent may be used.

In the case where two or more types of the above binder resins are used in combination, the mixing ratio between the binder resins may be set appropriately.

The undercoat layer may include various additives in order to enhance electrical properties, environmental stability, and image quality.

Examples of the additives include the following known materials: electron-transporting pigments such as polycondensed pigments and azo pigments, zirconium chelates, titanium chelates, aluminum chelates, titanium alkoxides, organic titanium compounds, and silane coupling agents. The silane coupling agents, which are used in the surface treatment of the inorganic particles as described above, may also be added to the undercoat layer as an additive.

Examples of silane coupling agents that may be used as an additive include vinyltrimethoxysilane, 3-methacryloxypropyl-tris(2-methoxyethoxy)silane, 2-(3,4-epoxycyclohexyl) ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethylmethoxysilane, N,N-bis(2-hydroxyethyl)-3-aminopropyltriethoxysilane, and 3-chloropropyltrimethoxysilane.

Examples of the zirconium chelates include zirconium butoxide, zirconium ethyl acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, and isostearate zirconium butoxide.

Examples of the titanium chelates include tetraisopropyl titanate, tetra-n-butyl titanate, butyl titanate dimer, tetra-(2-ethylhexyl) titanate, titanium acetylacetonate, polytitanium acetylacetonate, titanium octylene glycolate, titanium lactate ammonium salt, titanium lactate, titanium lactate ethyl ester, titanium triethanolamine, and polyhydroxy titanium stearate.

Examples of the aluminum chelates include aluminum isopropylate, monobutoxy aluminum diisopropylate, aluminum butyrate, diethyl acetoacetate aluminum diisopropylate, and aluminum tris(ethyl acetoacetate).

The above additives may be used alone. Alternatively, two or more types of the above additives may be used in a mixture or in the form of a polycondensate.

The undercoat layer may have a Vickers hardness of 35 or more.

In order to reduce the formation of moiré fringes, the surface roughness (i.e., ten-point-average roughness) of the undercoat layer may be adjusted to $1/(4n)$ to ½ of the wavelength $\lambda$ of the laser beam used as exposure light, where n is the refractive index of the layer that is to be formed on the undercoat layer.

Resin particles and the like may be added to the undercoat layer in order to adjust the surface roughness of the undercoat layer. Examples of the resin particles include silicone resin particles and crosslinked polymethyl methacrylate resin particles. The surface of the undercoat layer may be polished in order to adjust the surface roughness of the undercoat layer. For polishing the surface of the undercoat layer, buffing, sand blasting, wet honing, grinding, and the like may be performed.

A method for forming the undercoat layer is not limited, and known methods may be employed. For example, a coating film is formed using a coating liquid (hereinafter, referred to as "undercoat-layer-forming coating liquid") prepared by mixing the above-described components with a solvent, and the coating film is dried and, as needed, heated.

Examples of the solvent used for preparing the undercoat-layer-forming coating liquid include known organic solvents such as an alcohol solvent, an aromatic hydrocarbon solvent, a halogenated hydrocarbon solvent, a ketone solvent, a ketone alcohol solvent, an ether solvent, and an ester solvent.

Specific examples thereof include the following common organic solvents: methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

For dispersing the inorganic particles in the preparation of the undercoat-layer-forming coating liquid, for example, known equipment such as a roll mill, a ball mill, a vibrating ball mill, an Attritor, a sand mill, a colloid mill, and a paint shaker may be used.

For coating the conductive substrate with the undercoat-layer-forming coating liquid, for example, common methods such as blade coating, wire bar coating, spray coating, dip coating, bead coating, air knife coating, and curtain coating may be employed.

The thickness of the undercoat layer is preferably, for example, 15 μm or more and is more preferably 20 μm or more and 50 μm or less.

Intermediate Layer

Although not illustrated in the drawings, an intermediate layer may optionally be interposed between the undercoat layer and the photosensitive layer.

The intermediate layer includes, for example, a resin. Examples of the resin included in the intermediate layer include the following high-molecular compounds: acetal resins (e.g., polyvinyl butyral), polyvinyl alcohol resins, polyvinyl acetal resins, casein resins, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins.

The intermediate layer may include an organometallic compound. Examples of the organometallic compound included in the intermediate layer include organometallic compounds containing a metal atom such as a zirconium atom, a titanium atom, an aluminum atom, a manganese atom, or a silicon atom.

The above compounds included in the intermediate layer may be used alone. Alternatively, two or more types of the above compounds may be used in a mixture or in the form of a polycondensate.

In particular, the intermediate layer may include an organometallic compound containing a zirconium atom or a silicon atom.

A method for forming the intermediate layer is not limited, and known methods may be employed. For example, a coating film is formed using an intermediate-layer-forming coating liquid prepared by mixing the above-described components with a solvent, and the coating film is dried and, as needed, heated.

For forming the intermediate layer, common coating methods such as dip coating, push coating, wire bar coating, spray coating, blade coating, knife coating, and curtain coating may be employed.

The thickness of the intermediate layer may be, for example, 0.1 μm or more and 3 μm or less. It is possible to use the intermediate layer also as an undercoat layer.

Charge-Generating Layer

The charge-generating layer includes, for example, a charge-generating material and a binder resin. The charge-generating layer may be formed by the vapor deposition of the charge-generating material. A charge-generating layer formed by the vapor deposition of a charge-generating material may be used particularly in the case where an incoherent light source such as a light-emitting diode (LED) or an organic electroluminescence (EL) image array is used.

Examples of the charge-generating material include azo pigments such as bisazo and trisazo; annulated aromatic pigments such as dibromoanthanthrone; perylene pigments; pyrrolopyrrole pigments; phthalocyanine pigments; zinc oxide; and trigonal selenium.

Among the above charge-generating materials, in particular, a metal phthalocyanine pigment or a nonmetal phthalocyanine pigment may be used in consideration of exposure to a laser beam in the near-infrared region. Specifically, for example, hydroxygallium phthalocyanine, chlorogallium phthalocyanine, dichloro tin phthalocyanine, and titanyl phthalocyanine are more preferable.

Among the above-charge generating materials, annulated aromatic pigments such as dibromoanthanthrone; thioindigo pigments; porphyrazines; zinc oxide; trigonal selenium; and the bisazo pigments may be used in consideration of exposure to a laser beam in the near-ultraviolet region.

The above charge-generating materials may be used also in the case where an incoherent light source such as an LED or an organic EL image array, which emits light having a center wavelength of 450 nm or more and 780 nm or less, is used. However, when the thickness of the photosensitive layer is reduced to 20 μm or less in order to increase the resolution, the strength of the electric field in the photosensitive layer may be increased. This increases the occurrence of a reduction in the amount of charge generated due to the injection of charge form the support, that is, image defects referred to as "color spots", such as black spots. This becomes more pronounced when a p-type semiconductor that is likely to induce a dark current, such as trigonal selenium or a phthalocyanine pigment, is used as a charge-generating material.

In contrast, in the case where an n-type semiconductor such as an annulated aromatic pigment, a perylene pigment, or an azo pigment is used as a charge-generating material, the dark current is hardly induced and the occurrence of the image defects referred to as "color spots", such as black spots, may be reduced even when the thickness of the photosensitive layer is reduced.

Whether or not a charge-generating material is n-type is determined on the basis of the polarity of the photoelectric current that flows in the charge-generating material by a commonly used time-of-flight method. Specifically, a charge-generating material in which electrons are more easily transmitted as carriers than holes is determined to be n-type.

The binder resin included in the charge-generating layer is selected from various insulating resins. The binder resin may also be selected from organic photoconductive polymers such as poly-N-vinylcarbazole, polyvinyl anthracene, polyvinylpyrene, and polysilane.

Specific examples of the binder resin include a polyvinyl butyral resin, a polyarylate resin (e.g., polycondensate of a bisphenol and an aromatic dicarboxylic acid), a polycarbonate resin, a polyester resin, a phenoxy resin, a vinyl chloride-vinyl acetate copolymer, a polyamide resin, an acrylic resin, a polyacrylamide resin, a polyvinylpyridine resin, a cellulose resin, a urethane resin, an epoxy resin, casein, a polyvinyl alcohol resin, and a polyvinylpyrrolidone resin. The term "insulating" used herein refers to having a volume resistivity of $10^{13}$ Ωcm or more.

The above binder resins may be used alone or in a mixture of two or more.

The ratio of the amount of charge-generating material to the amount of binder resin may be 10:1 to 1:10 by weight.

The charge-generating layer may optionally include known additives.

A method for forming the charge-generating layer is not limited, and any known method may be employed. For example, the above components are dissolved in a solvent in order to form a coating liquid used for forming the charge-generating layer (hereinafter, referred to as "charge-generating-layer-forming coating liquid"). The charge-generating-layer-forming coating liquid is formed into a coating film, which is dried and, as needed, subsequently heated. Alternatively, the charge-generating layer may be formed by the vapor deposition of the charge-generating material. The charge-generating layer may be formed by the vapor deposition particularly when the charge-generating material is an annulated aromatic pigment or a perylene pigment.

Examples of the solvent used for preparing the charge-generating-layer-forming coating liquid include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. The above solvents may be used alone or in a mixture of two or more.

For dispersing particles of the charge-generating material or the like in the charge-generating-layer-forming coating liquid, for example, media dispersing machines such as a ball mill, a vibrating ball mill, an Attritor, a sand mill, and a horizontal sand mill; and medialess dispersing machines such as a stirrer, an ultrasonic wave disperser, a roll mill, and a high-pressure homogenizer may be used. Specific examples of the high-pressure homogenizer include an impact-type homogenizer in which a dispersion is brought into collision with a liquid or a wall under a high-pressure condition in order to perform dispersion; and a pass-through-type homogenizer in which a dispersion is passed through a very thin channel under a high-pressure condition in order to perform dispersion.

The average diameter of the particles of the charge-generating material dispersed in the charge-generating-layer-forming coating liquid may be 0.5 μm or less, is preferably 0.3 μm or less, and is further preferably 0.15 μm or less.

For applying the charge-generating-layer-forming coating liquid to the undercoat layer (or, the intermediate layer), for example, common coating methods such as blade coating, wire bar coating, spray coating, dip coating, bead coating, air knife coating, and curtain coating may be employed.

The charge-generating layer may be formed by dipping the above-described conductive support, which may optionally include the undercoat layer and the like disposed thereon, into the charge-generating-layer-forming coating liquid and withdrawing the conductive support from the coating liquid such that a charge-generating layer is formed on the outer periphery of the conductive support.

In the case where the charge-generating layer is formed by dip coating, the arithmetic average roughness $Ra_2$ of the photosensitive layer may be controlled to fall within the above range by, for example, adjusting the viscosity (mPa·s) of the charge-generating-layer-forming coating liquid; or, in the formation of a coating film corresponding to the charge-generating layer, dipping the conductive support into a coating tank containing the charge-generating-layer-forming coating liquid and subsequently withdrawing the conductive support from the coating tank at an appropriate withdrawal rate (mm/min). The arithmetic average roughness $Ra_2$ may also be controlled by changing the properties of the surface of the conductive support, that is, the arithmetic average roughness $Ra_1$ and the average length RSm.

The viscosity (mPa·s) of the charge-generating-layer-forming coating liquid is preferably 5 mPa·s or more and 100 mPa·s or less, is more preferably 15 mPa·s or more and 70 mPa·s or less, and is further preferably 20 mPa·s or more and 60 mPa·s or less in order to control the arithmetic average roughness $Ra_2$ of the photosensitive layer to fall within the above range.

A method for controlling the viscosity of the charge-generating-layer-forming coating liquid to fall within the above range is not limited. The viscosity of the charge-generating-layer-forming coating liquid may be controlled by, for example, adjusting the ratio between the amounts of materials of the charge-generating layer, such as the charge-generating material and the binder resin, and the amount of solvent in the preparation of the charge-generating-layer-forming coating liquid.

The withdrawal rate (mm/min) at which the conductive support is withdrawn from the coating tank containing the charge-generating-layer-forming coating liquid in the formation of the coating film corresponding to the charge-generating layer is preferably 60 mm/min or more and 300 mm/min or less, is more preferably 80 mm/min or more and 250 mm/min or less, and is further preferably 100 mm/min or more and 200 mm/min or less in order to control the arithmetic average roughness $Ra_2$ of the photosensitive layer to fall within the above range.

The thickness of the charge-generating layer is, for example, preferably 0.1 μm or more and 5.0 μm or less and is more preferably 0.2 μm or more and 2.0 μm or less.

Charge-Transporting Layer

The charge-transporting layer includes, for example, a charge-transporting material and a binder resin. The charge-transporting layer may include a polymeric charge-transporting material.

Examples of the charge-transporting material include, but are not limited to, the following electron-transporting compounds: quinones such as p-benzoquinone, chloranil, bromanil, and anthraquinone; tetracyanoquinodimethane compounds; fluorenones such as 2,4,7-trinitrofluorenone; xanthones; benzophenones; cyanovinyl compounds; and ethylenes. Examples of the charge-transporting material further include hole-transporting compounds such as triarylamines, benzidines, arylalkanes, aryl-substituted ethylenes, stilbenes, anthracenes, and hydrazones. The above charge-transporting materials may be used alone or in combination of two or more.

In particular, the triarylamine derivative represented by Structural Formula (a-1) below or the benzidine derivative represented by Structural Formula (a-2) below may be used as a charge-transporting material in consideration of the mobility of charge.

(a-1)

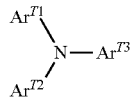

In Structural Formula (a-1), $Ar^{T1}$, $Ar^{T2}$, and $Ar^{T3}$ each independently represent an aryl group, a substituted aryl group, a $—C_6H_4—C(R^{T4})=C(R^{T5})(R^{T6})$ group, or a $—C_6H_4—CH=CH—CH=C(R^{T7})(R^{T8})$ group, where $R^{T4}$, $R^{T5}$, $R^{T6}$, $R^{T7}$, and $R^{T8}$ each independently represent a hydrogen atom, an alkyl group, a substituted alkyl group, an aryl group, or a substituted aryl group.

Examples of a substituent included in the above substituted groups include a halogen atom, an alkyl group having from 1 to 5 carbon atoms, an alkoxy group having from 1 to 5 carbon atoms, and an amino group substituted with an alkyl group having from 1 to 3 carbon atoms.

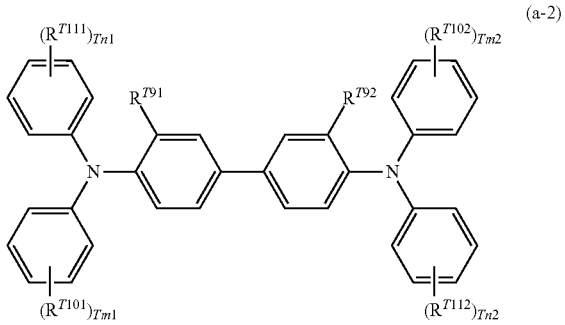

In Structural Formula (a-2), $R^{T91}$ and $R^{T92}$ each independently represent a hydrogen atom, a halogen atom, an alkyl group having from 1 to 5 carbon atoms, or an alkoxy group having from 1 to 5 carbon atoms; $R^{T101}$, $R^{T102}$, $R^{T111}$, and $R^{T112}$ each independently represent a halogen atom, an alkyl group having from 1 to 5 carbon atoms, an alkoxy group having from 1 to 5 carbon atoms, an amino group substituted with an alkyl group having 1 or 2 carbon atoms, an aryl group, a substituted aryl group, a $—C(R^{T12})=C(R^{T13})(R^{T14})$ group, or a $—CH=CH—CH=C(R^{T15})(R^{T16})$ group, where $R^{T12}$, $R^{T13}$, $R^{T14}$, $R^{T15}$, and $R^{T16}$ each independently represent a hydrogen atom, an alkyl group, a substituted alkyl group, an aryl group, or a substituted aryl group; and $Tm_1$, $Tm_2$, $Tn_1$, and $Tn_2$ each independently represent an integer of 0 to 2.

Examples of a substituent included in the above substituted groups include a halogen atom, an alkyl group having from 1 to 5 carbon atoms, an alkoxy group having from 1 to 5 carbon atoms, and an amino group substituted with an alkyl group having from 1 to 3 carbon atoms.

Among triarylamine derivatives represented by Structural Formula (a-1) above and benzidine derivatives represented by Structural Formula (a-2) above, in particular, a triarylamine derivative that includes the "$—C_6H_4—CH=CH—CH=C(R^{T7})(R^{T8})$" group and a benzidine derivative that includes the "$—CH=CH—CH=C(R^{T15})(R^{T16})$" group may be used in consideration of the mobility of charge.

The polymeric charge-transporting material may be any known charge-transporting compound such as poly-N-vinylcarbazole or polysilane. In particular, polyester-based polymeric charge-transporting materials may be used. The above polymeric charge-transporting materials may be used alone or in combination of the above binder resins.

Examples of the binder resin included in the charge-transporting layer include a polycarbonate resin, a polyester resin, a polyarylate resin, a methacrylic resin, an acrylic resin, a polyvinyl chloride resin, a polyvinylidene chloride resin, a polystyrene resin, a polyvinyl acetate resin, a styrene-butadiene copolymer, a vinylidene chloride-acrylonitrile copolymer, a vinyl chloride-vinyl acetate copolymer, a vinyl chloride-vinyl acetate-maleic anhydride copolymer, a silicone resin, a silicone alkyd resin, a phenol-formaldehyde resin, a styrene-alkyd resin, poly-N-vinylcarbazole, and polysilane. Among the above binder resins, in particular, a polycarbonate resin and a polyarylate resin may be used. The above binder resins may be used alone or in combination of two or more.

The ratio of the amount of charge-transporting material to the amount of binder resin may be 10:1 to 1:5 by weight.

The charge-transporting layer may optionally include known additives.

A method for forming the charge-transporting layer is not limited, and any known method may be employed. For example, the above components are dissolved in a solvent in order to form a coating liquid used for forming the charge-transporting layer (hereinafter, referred to as "charge-transporting-layer-forming coating liquid"). The charge-transporting-layer-forming coating liquid is formed into a coating film, which is dried and, as needed, subsequently heated.

Examples of the solvent used for preparing the charge-transporting-layer-forming coating liquid include the following common organic solvents: aromatic hydrocarbons such as benzene, toluene, xylene, and chlorobenzene; ketones such as acetone and 2-butanone; halogenated aliphatic hydrocarbons such as methylene chloride, chloroform, and ethylene chloride; and cyclic and linear ethers such as tetrahydrofuran and ethyl ether. The above solvents may be used alone or in a mixture of two or more.

Method for Forming Charge-Transporting Layer

The charge-transporting layer included in the photoreceptor according to this exemplary embodiment is formed by applying the above-described charge-transporting-layer-forming coating liquid onto the surface of the conductive support on which the above-described charge-generating layer has been formed and drying the resulting coating film. In this exemplary embodiment, for applying the charge-transporting-layer-forming coating liquid to the conductive support, for example, common coating methods such as dip coating, blade coating, wire bar coating, spray coating, bead coating, air knife coating, and curtain coating may be employed.

The photoreceptor according to this exemplary embodiment includes a photosensitive layer including a surface having an arithmetic average roughness $Ra_2$ of 0.05 μm or more and 0.8 μm or less in order to reduce the occurrence of the minute line defects, which are likely to occur when DC contact charging is employed, and the occurrence of color spots.

The charge-transporting layer may be formed by dipping the above-described conductive support, which includes the charge-generating layer disposed thereon, into the charge-transporting-layer-forming coating liquid and withdrawing the conductive support from the coating liquid such that a charge-transporting layer is formed on the outer periphery of the charge-generating layer.

In the case where the charge-transporting layer is formed by dip coating, the arithmetic average roughness $Ra_2$ of the photosensitive layer may be controlled to fall within the above range by, for example, adjusting the viscosity (mPa·s) of the charge-transporting-layer-forming coating liquid; or, in the formation of a coating film corresponding to the charge-transporting layer, dipping the conductive support into a coating tank containing the charge-transporting-layer-forming coating liquid and subsequently withdrawing the conductive support from the coating tank at an appropriate withdrawal rate (mm/min). The arithmetic average roughness $Ra_2$ may also be controlled by changing the properties of the surface of the conductive support, that is, the arithmetic average roughness $Ra_1$ and the average length RSm.

The viscosity (mPa·s) of the charge-transporting-layer-forming coating liquid is preferably 80 mPa·s or more and 600 mPa·s or less, is more preferably 100 mPa·s or more and 500 mPa·s or less, and is further preferably 110 mPa·s or more and 400 mPa·s or less in order to control the arithmetic average roughness $Ra_2$ of the photosensitive layer to fall within the above range.

A method for controlling the viscosity of the charge-transporting-layer-forming coating liquid to fall within the above range is not limited. The viscosity of the charge-transporting-layer-forming coating liquid may be controlled by, for example, adjusting the ratio between the amounts of materials of the charge-transporting layer, such as the charge-transporting material and the binder resin, and the amount of solvent in the preparation of the charge-transporting-layer-forming coating liquid.

The withdrawal rate (mm/min) at which the conductive support is withdrawn from the coating tank containing the charge-transporting-layer-forming coating liquid in the formation of the coating film corresponding to the charge-transporting layer is preferably 20 mm/min or more and 300 mm/min or less, is more preferably 40 mm/min or more and 240 mm/min or less, and is further preferably 60 mm/min or more and 180 mm/min or less in order to control the arithmetic average roughness $Ra_2$ of the photosensitive layer to fall within the above range.

A method in which the conductive support including the charge-generating layer disposed thereon is dipped into the charge-transporting-layer-forming coating liquid and subsequently withdrawn from the charge-transporting-layer-forming coating liquid in order to form a charge-transporting layer on the outer periphery of the charge-generating layer is described below.

An example of a dip coating method in which a conductive support including a charge-generating layer is dipped into a charge-transporting-layer-forming coating liquid and subsequently withdrawn from the coating liquid is described below with reference to the attached drawing.

Figure 4:
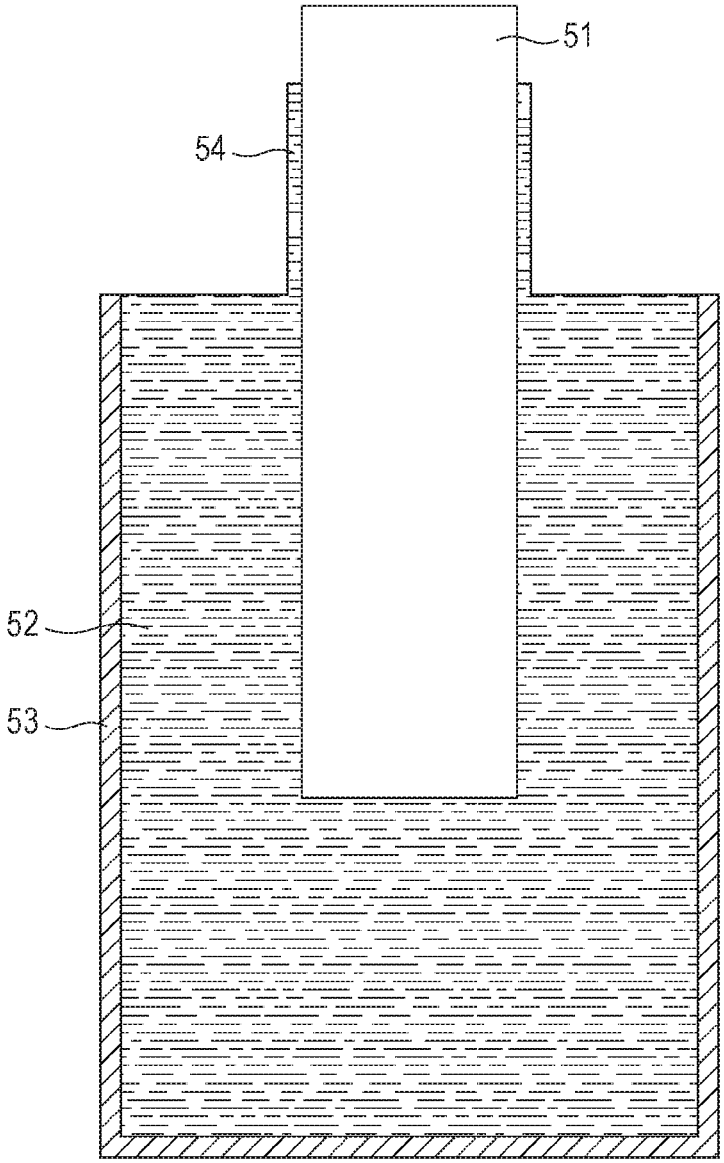
FIG. 4 is a schematic cross-sectional view of a dip-coating device used in an exemplary embodiment.

FIG. 4 is a schematic cross-sectional view of a dip-coating device, illustrating the structure of the dip-coating device. Note that, the expression "applied to the conductive support" used herein refers to being applied onto the surface of the conductive support including the charge-generating layer disposed thereon, that is, onto the surface of the charge-generating layer. The expression "conductive support is moved upward" used herein refers to the motion of the conductive support relative to the surface of the charge-transporting-layer-forming coating liquid and includes the case where the height of the surface of the charge-transporting-layer-forming coating liquid is reduced while the conductive support is fixed.

In FIG. 4, a charge-transporting-layer-forming coating liquid 52 is charged into a coating tank 53. The charge-transporting-layer-forming coating liquid 52 is applied to a conductive support 51 including a charge-generating layer disposed thereon when the conductive support 51 is dipped into the coating tank 53 and withdrawn from, that is, moved upward relative to, the coating tank 53. Thus, a coating film 54 is formed on the surface of the conductive support 51. During the formation of the coating film 54, the charge-transporting-layer-forming coating liquid 52 may be supplied to the coating tank 53 from the bottom so as to overflow from the coating tank 53. In such a case, a receiver (not illustrated) is disposed around the coating tank in order to collect the overflowed charge-transporting-layer-forming coating liquid 52.

The thickness of the charge-transporting layer is, for example, preferably 5 μm or more and 50 μm or less and is more preferably 10 μm or more and 30 μm or less in order to control the arithmetic average roughness $Ra_2$ of the photosensitive layer to fall within the above range.

Single-Layer Photosensitive Layer

A single-layer photosensitive layer (i.e., charge-generating and transporting layer) includes, for example, a charge-generating material, a charge-transporting material, and, as needed, a binder resin and known additives. These materials are the same as those described in Charge-Generating Layer and Charge-Transporting Layer above.

The amount of charge-generating material may be 10% by weight or more and 85% by weight or less and is preferably 20% by weight or more and 50% by weight or less of the total solid content of the single-layer photosensitive layer. The amount of charge-transporting material may be 5% by weight or more and 50% by weight or less of the total solid content of the single-layer photosensitive layer.

The single-layer photosensitive layer may be formed by the same method as the charge-generating layer and the charge-transporting layer.

The thickness of the single-layer photosensitive layer may be, for example, 5 μm or more and 50 μm or less and is preferably 10 μm or more and 40 μm or less.

Image-Forming Apparatus and Process Cartridge

An image-forming apparatus according to an exemplary embodiment includes the electrophotographic photoreceptor according to the above-described exemplary embodiment; a charging unit that charges the surface of the electrophotographic photoreceptor by contact charging in which only a direct voltage is applied to the surface of the electrophotographic photoreceptor, that is, a DC-contact charging unit; an electrostatic-latent-image-forming unit that forms an electrostatic latent image on the charged surface of the electrophotographic photoreceptor; a developing unit that develops the electrostatic latent image formed on the surface of the electrophotographic photoreceptor with a developer including a toner in order to form a toner image; and a transfer unit that transfers the toner image onto the surface of a recording medium.

The image-forming apparatus according to this exemplary embodiment may be implemented as any of the following known image-forming apparatuses: an image-forming apparatus that includes a fixing unit that fixes the toner image transferred on the surface of the recording medium; a direct-transfer image-forming apparatus that directly transfers the toner image formed on the surface of the electrophotographic photoreceptor onto the surface of a recording medium; an intermediate-transfer image-forming apparatus that transfers the toner image formed on the surface of the electrophotographic photoreceptor onto the surface of an intermediate transfer body (this process is referred to as "first transfer") and further transfers the toner image transferred on the surface of the intermediate transfer body onto the surface of a recording medium (this process is referred to as "second transfer"); an image-forming apparatus that includes a cleaning unit that cleans the surface of an electrophotographic photoreceptor which has not yet been charged after a toner image has been transferred; an image-forming apparatus that includes a charge-eliminating unit that irradiates, with charge-elimination light, the surface of an electrophotographic photoreceptor which has not yet been charged after a toner image has been transferred in order to eliminate charge; and an image-forming apparatus that includes an electrophotographic-photoreceptor-heating member that heats the electrophotographic photoreceptor in order to lower the relative temperature of the electrophotographic photoreceptor.

In the intermediate-transfer image-forming apparatus, the transfer unit includes, for example, an intermediate transfer body onto which a toner image is transferred, a first transfer unit that transfers a toner image formed on the surface of the electrophotographic photoreceptor onto the surface of the intermediate transfer body (first transfer), and a second transfer unit that transfers the toner image transferred on the surface of the intermediate transfer body onto the surface of a recording medium (second transfer).

The image-forming apparatus according to this exemplary embodiment may be a dry-developing image-forming apparatus or a wet-developing image-forming apparatus, which develops images with a liquid developer.

In the image-forming apparatus according to this exemplary embodiment, for example, a portion including the electrophotographic photoreceptor according to the above-described exemplary embodiment and the DC-contact charging unit may have a cartridge structure, that is, may be a process cartridge, which is detachably attachable to the image-forming apparatus. The process cartridge may include, for example, the electrophotographic photoreceptor according to the above-described exemplary embodiment and the DC-contact charging unit.

The process cartridge may further include, for example, at least one component selected from the group consisting of the electrostatic-latent-image-forming unit, the developing unit, and the transfer unit.

An example of the image-forming apparatus according to this exemplary embodiment is described below. However, the image-forming apparatus is not limited to this. Hereinafter, only the components illustrated in the drawings are described, and the descriptions of the other components are omitted.

Figure 5:
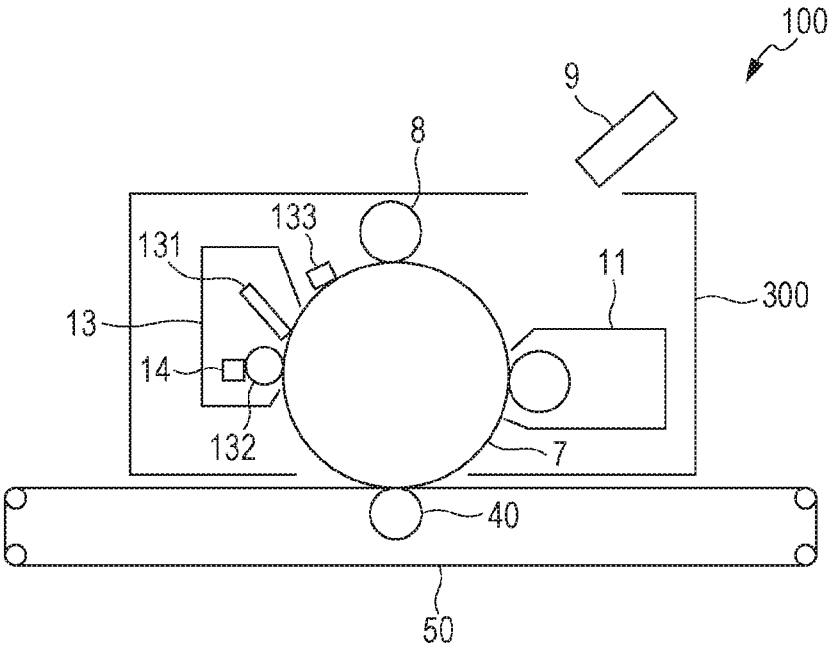
FIG. 5 is a diagram schematically illustrating the structure of an image-forming apparatus according to an exemplary embodiment.

FIG. 5 schematically illustrates an example of the image-forming apparatus according to this exemplary embodiment.

As illustrated in FIG. 5, an image-forming apparatus 100 according to this exemplary embodiment includes a process cartridge 300 including an electrophotographic photoreceptor 7, an exposure device 9 (an example of the electrostatic-latent-image-forming unit), a transfer device 40 (i.e., first transfer device), and an intermediate transfer body 50. In the image-forming apparatus 100, the exposure device 9 is arranged such that the electrophotographic photoreceptor 7 is exposed to light emitted by the exposure device 9 through an aperture formed in the process cartridge 300; the transfer device 40 is arranged to face the electrophotographic photoreceptor 7 with the intermediate transfer body 50 interposed therebetween; and the intermediate transfer body 50 is arranged such that part of the intermediate transfer body 50 comes into contact with the electrophotographic photoreceptor 7. Although not illustrated in the drawing, the image-forming apparatus 100 also includes a second transfer device that transfers a toner image transferred on the intermediate transfer body 50 onto a recording medium such as paper. In the image-forming apparatus 100, the intermediate transfer body 50, the transfer device 40 (i.e., first transfer device), and the second transfer device (not illustrated) correspond to an example of the transfer unit.

The process cartridge 300 illustrated in FIG. 5 includes the electrophotographic photoreceptor 7 according to the above-described exemplary embodiment, a charging device 8 (an example of the charging unit), a developing device 11 (an example of the developing unit), and a cleaning device 13 (an example of the cleaning unit), which are integrally supported inside a housing. The cleaning device 13 includes a cleaning blade 131 (an example of the cleaning member), which is arranged to come into contact with the surface of the electrophotographic photoreceptor 7. The form of the cleaning member is not limited to the cleaning blade 131 and may be, for example, a conductive or insulating fibrous member. The conductive or insulating fibrous member may be used alone or in combination with the cleaning blade 131.

The image-forming apparatus illustrated in FIG. 5 includes a roller-like, fibrous member 132 with which a lubricant 14 is fed onto the surface of the electrophotographic photoreceptor 7 and a flat-brush-like, fibrous member 133 that assists cleaning. However, the image-forming apparatus illustrated in FIG. 5 is merely an example, and the fibrous members 132 and 133 are optional.

The components of the image-forming apparatus according to this exemplary embodiment are each described below.

Charging Device

The charging device 8 is a DC-contact charging device that includes a charging roller and charges the surface of the electrophotographic photoreceptor 7 by the application of a direct voltage. The applied voltage is, for example, a positive or negative direct voltage of 50 V or more and 2,000 V or less, which varies depending on the required charge potential of the electrophotographic photoreceptor 7.

The pressure at which the charging roller is brought into contact with the electrophotographic photoreceptor 7 is, for example, 250 mgf or more and 600 mgf or less.

When the charging roller is in contact with the surface of the electrophotographic photoreceptor 7, it can be rotated by the rotation of the electrophotographic photoreceptor 7 even in the case where the charging device does not include a driving unit. Alternatively, a driving unit may be attached to the charging roller and the charging roller may be rotated at a peripheral velocity different from that of the electrophotographic photoreceptor 7.

Exposure Device

The exposure device 9 may be, for example, an optical device with which the surface of the electrophotographic photoreceptor 7 can be exposed to light emitted by a semiconductor laser, an LED, a liquid-crystal shutter, or the like in a predetermined image pattern. The wavelength of the light source is set to fall within the range of the spectral sensitivity of the electrophotographic photoreceptor. Although common semiconductor lasers have an oscillation wavelength in the vicinity of 780 nm, that is, the near-infrared region, the wavelength of the light source is not limited to this; semiconductor lasers having an oscillation wavelength of about 600 to 700 nm and blue semiconductor lasers having an oscillation wavelength of 400 nm or more and 450 nm or less may also be used. For forming color images, surface-emitting lasers capable of emitting multi beam may be used as a light source.

Developing Device

The developing device 11 may be, for example, a common developing device that develops latent images with a developer in a contacting or noncontacting manner. The type of the developing device 11 is not limited and may be selected from those having the above functions depending on the purpose. Examples of such a developing device include known developing devices capable of depositing a one- or two-component developer on the electrophotographic photoreceptor 7 with a brush, a roller, or the like. In particular, a developing device including a developing roller on which a developer is deposited may be used.

The developer included in the developing device 11 may be a one-component developer including only a toner or a two-component developer including a toner and a carrier. The developer may be magnetic or nonmagnetic. Known developers may be used as a developer included in the developing device 11.

Cleaning Device

The cleaning device 13 may be, for example, a cleaning-blade-type cleaning device including a cleaning blade 131.

The type of the cleaning device 13 is not limited to the cleaning-blade-type cleaning device, and a fur-brush-cleaning-type cleaning device may also be used. In another case, cleaning and development may be performed at the same time.

Transfer Device

The transfer device 40 may be, for example, any of the following known transfer chargers: contact transfer chargers including a belt, a roller, a film, a rubber blade, or the like; and transfer chargers which utilize corona discharge, such as a scorotron and a corotron.

Intermediate Transfer Body

The intermediate transfer body 50 may be, for example, a belt-like intermediate transfer body, that is, an intermediate transfer belt, including polyimide, polyamideimide, polycarbonate, polyarylate, polyester, a rubber, or the like that is made semiconductive. The intermediate transfer body is not limited to a belt-like intermediate transfer body and may be a drum-like intermediate transfer body.

Figure 6:
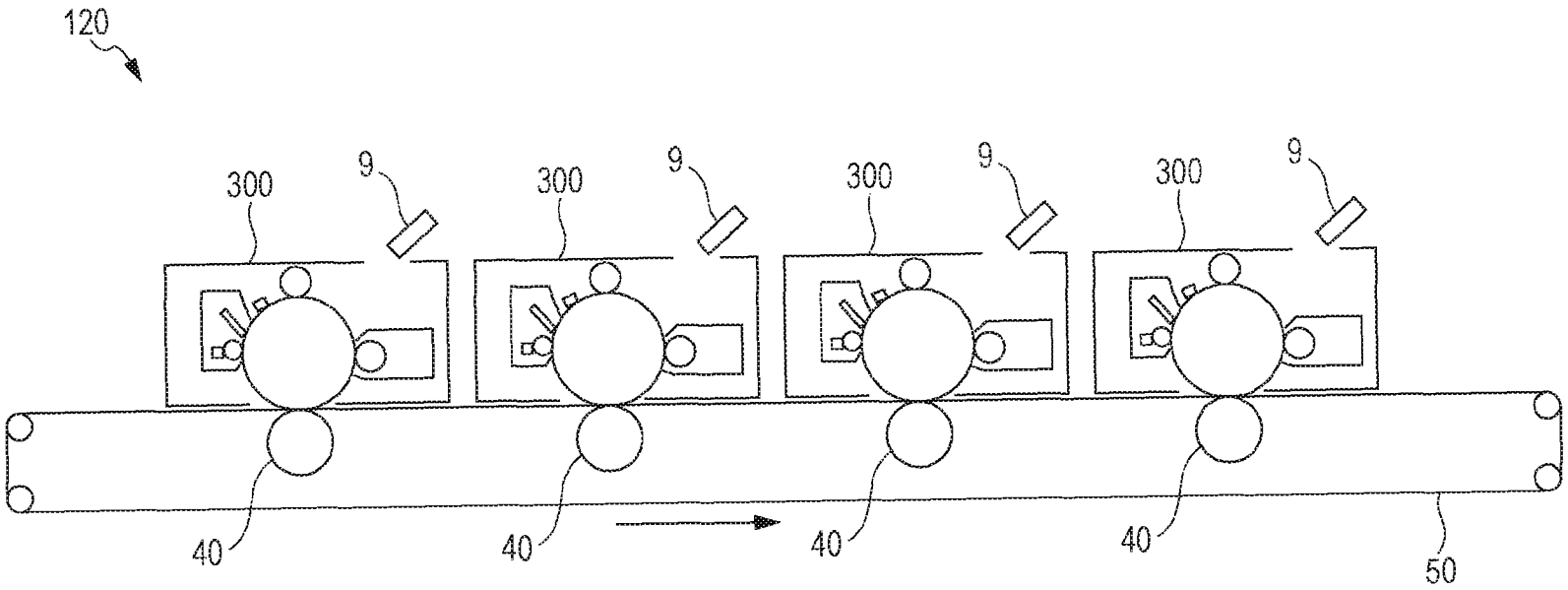
FIG. 6 is a diagram schematically illustrating the structure of an image-forming apparatus according to another exemplary embodiment.

FIG. 6 schematically illustrates another example of the image-forming apparatus according to this exemplary embodiment.

An image-forming apparatus 120 illustrated in FIG. 6 is a tandem, multi-color image-forming apparatus including four process cartridges 300. In the image-forming apparatus 120, the four process cartridges 300 are arranged in parallel to one another on an intermediate transfer body 50, and one electrophotographic photoreceptor is used for one color. The image-forming apparatus 120 has the same structure as the image-forming apparatus 100 except that the image-forming apparatus 120 is tandem.

EXAMPLES

Examples of the above-described exemplary embodiments are described below. The invention is not limited by Examples below. Hereinafter, "part" is on a weight basis unless otherwise specified.

Preparation of Conductive Supports

Preparation of Conductive Support (1)

An aluminum machined pipe (diameter: 30 mm, length: 251 mm, and radial thickness: 0.75 mm) that is a hollow, cylindrical pipe formed by drawing followed by grinding is prepared.

The surface of the machined pipe is subjected to blasting under the following conditions. Thus, an aluminum conductive support (1) is prepared.

Blasting Conditions

Material of abrasive (medium): zirconia

Size of abrasive particles: 60 μm

Abrasive-irradiation pressure: 0.1 MPa

Abrasive-irradiation time: 30 seconds

Preparation of Conductive Supports (2), (3), (4), and (1C) to (3C)

Conductive supports (2), (3), (4), and (1C) to (3C) are prepared as in Preparation of Conductive Support (1), except that the blasting conditions, that is, the abrasive-irradiation pressure and the abrasive-irradiation time, are changed as shown in Tables 1 and 2.

Preparation of Conductive Support (5)

An aluminum impact-pressed pipe (diameter: 30 mm, length: 251 mm, and radial thickness: 0.5 mm) that is a hollow, cylindrical pipe formed by impact pressing is prepared.

The surface of the impact-pressed pipe (hereinafter, referred to as "IP pipe") is subjected to blasting under the following conditions. Thus, an aluminum conductive support (5) is prepared.

Blasting Conditions

Material of abrasive (medium): zirconia

Size of abrasive particles: 60 μm

Abrasive-irradiation pressure: 0.1 MPa

Abrasive-irradiation time: 30 seconds

Properties of Conductive Supports

The arithmetic average roughness $Ra_1$ and the average length RSm in the axial direction of each of the conductive supports (1) to (5) and (1C) to (3C) are determined by the above-described methods. Tables 1 and 2 summarize the results.

Example 1

Preparation of Photoreceptor

With 100 parts by weight of zinc oxide "MZ 300" produced by TAYCA CORPORATION, 10 parts by weight of a 10% by weight toluene solution of N-2-(aminoethyl)-3-aminopropyltriethoxysilane, which serves as a silane coupling agent, and 200 parts by weight of toluene are mixed. The resulting mixture is stirred and refluxed for two hours. Subsequently, toluene is distilled away under a reduced pressure of 10 mmHg, and baking is performed at 135° C. for 2 hours in order to treat the surfaces of the zinc oxide particles with the silane coupling agent.

With 33 parts by weight of the surface-treated zinc oxide particles, 6 parts by weight of blocked isocyanate "Sumidur 3175" produced by Sumitomo Bayer Urethane Co., Ltd., 1 part by weight of the compound represented by Structural Formula (AK-1) below, and 25 parts by weight of methyl ethyl ketone are mixed for 30 minutes. To the resulting mixture, 5 parts by weight of a butyral resin "S-LEC BM-1" produced by Sekisui Chemical Co. Ltd., 3 parts by weight of silicone beads "Tospearl 120" produced by Momentive Performance Materials Inc., and 0.01 parts by weight of a silicone oil "SH29PA" produced by Dow Corning Toray Silicone Co., Ltd., which serves as a leveling agent, are added. The resulting mixture is dispersed for three hours with a sand mill to form an undercoat-layer-forming coating liquid.

The undercoat-layer-forming coating liquid is applied to the conductive support (1) by dip coating. The resulting coating film is dried at 180° C. for 30 minutes and cured. Thus, an undercoat layer having a thickness of 30 μm is formed on the conductive support (1).

(AK-1)

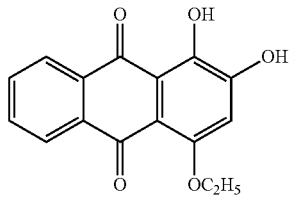

As a charge-generating material, a V-type hydroxygallium phthalocyanine pigment having a diffraction peak at, at least, Bragg angles (2θ±0.2°) of 7.3°, 16.0°, 24.9°, and 28.0° in an X-ray diffraction spectrum measured with the CuKα radiation (maximum peak wavelength in a spectral absorption spectrum that covers the range of 600 nm or more and 900 nm or less: 820 nm, average particle diameter: 0.12 μm, maximum particle diameter: 0.2 μm, specific surface area: 60 $m^2/g$) is prepared. The hydroxygallium phthalocyanine pigment, a vinyl chloride-vinyl acetate copolymer "VMCH" produced by Nippon Unicar Company Limited, which serves as a binder resin, and n-butyl acetate are mixed together. The resulting mixture and glass beads having a diameter of 1.0 mm are charged into a glass bottle having a capacity of 100 mL at a filling proportion of 50%. The mixture is dispersed for 2.5 hours with a paint shaker to form a charge-generating-layer-forming coating liquid. The content of the hydroxygallium phthalocyanine pigment in the mixture of the hydroxygallium phthalocyanine pigment and the vinyl chloride-vinyl acetate copolymer is 55.0% by volume. The solid content in the dispersion liquid is 6.0% by weight. In the calculation of the content of the hydroxygallium phthalocyanine pigment, the specific gravities of the hydroxygallium phthalocyanine pigment and the vinyl chloride-vinyl acetate copolymer are assumed to be 1.606 g/cm$^3$ and 1.35 g/cm$^3$, respectively.

The charge-generating-layer-forming coating liquid is applied to the undercoat layer by dip coating. The resulting coating film is dried at 130° C. for 5 minutes. Thus, a charge-generating layer having a thickness of 0.20 μm is formed on the under coating layer.

To 340 parts by weight of tetrahydrofuran, 8 parts by weight of a butadiene-based charge-transporting material (CT1A), 32 parts by weight of a benzidine-based charge-transporting material (CT2A), 58 parts by weight of a bisphenol-Z-based polycarbonate resin (polycarbonate resin produced by the homopolymerization of bisphenol Z, viscosity-average molecular weight: 40,000), which serves as a binder resin, and 2 parts by weight (5% by weight relative to 100% by weight of the total amount of the charge-transporting materials) of a hindered phenol antioxidant (HP-1, molecular weight: 775) are dissolved. The resulting solution is dispersed with a ball mill to form a charge-transporting-layer-forming coating liquid (hereinafter, referred to as "CT coating liquid") having a viscosity of 120 mPa·s.

A charge-transporting layer is formed on the surface, that is, the outer periphery, of the conductive support (1) with the dip-coating device illustrated in FIG. 4 by the following method.

The CT coating liquid is charged into a coating tank 53 included in the dip-coating device illustrated in FIG. 4. The conductive support (1) including the undercoat layer and the charge-generating layer disposed thereon is dipped into the coating tank 53 and subsequently withdrawn from the coating tank 53 at a withdrawal rate of 120 mm/min. The resulting coating film is dried at 145° C. for 30 minutes. Thus, a charge-transporting layer having a thickness of 30 μm is formed on the surface of the conductive support (1) that included the undercoat layer and the charge-generating layer disposed thereon. A photoreceptor is prepared in the above-described manner.

Examples 2 to 5 and Comparative Examples 1 to 3

In Examples 2 to 5 and Comparative Examples 1 to 3, a photoreceptor is prepared as in Example 1, except that the type of conductive support used is changed as shown in Tables 1 and 2.

Evaluation of Minute Line Defects

The photoreceptors prepared in Examples 1 to 5 and Comparative examples 1 to 3 above are each attached to an image-forming apparatus "DocuPrint C1100" produced by Fuji Xerox Co., Ltd. A 50%-halftone image is formed under conditions of 20° C. and 40% RH by negatively charging the surface of the photoreceptor and irradiating the surface of the photoreceptor with monochromatic light having a wavelength of 780 nm. The image is inspected for minute line defects (width: 2 mm or less, length: 30 mm or less), and an evaluation is made in accordance with the following criteria.

It is considered that minute line defects rated "4" or "5" may impair the function of the photoreceptor.

Evaluation Criteria

1: Excellent (minute line defects are not found)

2: Good (the number of minute line defects is 1; few minute line defects are found)

3: Fair (the number of minute line defects is 2 to 5; minute line defects are at an acceptable level at which the function of the photoreceptor is not impaired)

4: Poor (the number of minute line defects is 6 to 8; the function of the photoreceptor may be impaired)

5: Bad (the number of minute line defects is 9 or more; the function of the photoreceptor may be impaired)

Evaluation of Color Spots

The photoreceptors prepared in Examples 1 to 5 and Comparative examples 1 to 3 above are each attached to an image-forming apparatus "DocuPrint C1100" produced by Fuji Xerox Co., Ltd. A 50%-halftone image is formed under conditions of 20° C. and 40% RH by negatively charging the surface of the photoreceptor and irradiating the surface of the photoreceptor with monochromatic light having a wavelength of 780 nm. The image is inspected for color spots. Tables 1 and 2 summarize the results.

Table 3 lists the criteria used in the evaluation. Details of the method for evaluating the color spots are as follows. Point defects (i.e., color spots) present in each image are classified into three groups by size (i.e., area). The three groups of point defects are each evaluated on the basis of the number of point defects included in the group. The lowest (i.e., the largest number) of the ratings of the three groups is considered to be the evaluation of the color spots of the photoreceptor. Specifically, for example, when the number of point defects having a size of less than 0.05 mm$^2$ is 11, the number of point defects having a size of 0.05 mm$^2$ or more and less than 0.1 mm$^2$ is 2, and the number of point defects having a size of 0.1 mm$^2$ or more is 0, a rating of "8" is given. Color spots rated 4 or less are considered to fall within the range acceptable in the practical use.

TABLE 1

| | Conductive support | | | | | | Photosensitive layer | | | Image quality evaluation | |
|---|---|---|---|---|---|---|---|---|---|---|---|
| | | | Blasting conditions | | Properties | | CT coating liquid | | Property | | |
| | Type of support | Radial thickness [mm] | Irradiation pressure [MPa] | Time [sec] | Average roughness $Ra_1$ [μm] | Average length Rsm [μm] | Viscosity [mPa • s] | Withdrawal rate [mm/min] | Average roughness $Ra_2$ [μm] | Minute line defects | Color spots |
| Example 1 | (1) | 0.75 | 0.1 | 30 | 0.3 | 220 | 120 | 120 | 0.05 | 3 | 1 |
| Example 2 | (2) | 0.75 | 0.3 | 60 | 1.0 | 395 | 120 | 120 | 0.80 | 1 | 4 |

TABLE 1-continued

| | Conductive support | | | | | | Photosensitive layer | | | | |
|---|---|---|---|---|---|---|---|---|---|---|---|
| | | | Blasting conditions | | Properties | | CT coating liquid | | Property | Image quality evaluation | |
| | Type of support | Radial thickness [mm] | Irradiation pressure [MPa] | Time [sec] | Average roughness $Ra_1$ [μm] | Average length Rsm [μm] | Viscosity [mPa • s] | Withdrawal rate [mm/min] | Average roughness $Ra_2$ [μm] | Minute line defects | Color spots |
| Example 3 | (3) | 0.75 | 0.1 | 60 | 0.3 | 395 | 120 | 120 | 0.15 | 2 | 1 |
| Example 4 | (4) | 0.75 | 0.2 | 30 | 0.7 | 290 | 120 | 120 | 0.05 | 1 | 1 |
| Example 5 | (5) | 0.50 | 0.1 | 30 | 0.7 | 290 | 120 | 120 | 0.05 | 1 | 1 |

TABLE 2

| | Conductive support | | | | | | Photosensitive layer | | | | |
|---|---|---|---|---|---|---|---|---|---|---|---|
| | | | Blasting conditions | | Properties | | CT coating liquid | | Property | Image quality evaluation | |
| | Type of support | Radial thickness [mm] | Irradiation pressure [MPa] | Time [sec] | Average roughness $Ra_1$ [μm] | Average length Rsm [μm] | Viscosity [mPa • s] | Withdrawal rate [mm/min] | Average roughness $Ra_2$ [μm] | Minute line defects | Color spots |
| Comparative example 1 | (1C) | 0.75 | 0.5 | 60 | 1.5 | 395 | 120 | 120 | 0.8 | 4 | 8 |
| Comparative example 2 | (2C) | 0.75 | 0.3 | 90 | 1.0 | 390 | 120 | 120 | 0.9 | 3 | 8 |
| Comparative example 3 | (3C) | 0.75 | 0.1 | 60 | 0.8 | 410 | 120 | 120 | 0.5 | 5 | 4 |

TABLE 3

| | Standard of color spots | | |
|---|---|---|---|
| Rating | Less than 0.05 $mm^2$ | 0.05 $mm^2$ or more and 0.1 $mm^2$ or less | 0.1 $mm^2$ or more |
| 1 | 0 | 0 | 0 |
| 2 | 1 | 1 | 0 |
| 3 | 2 | 1 | 0 |
| 4 | 3 | 1 | 0 |
| 5 | 4 or 5 | 1 | 0 |
| 6 | 6 or 7 | 1 | 1 |
| 7 | 8 or 9 | 2 | 2 |
| 8 | 10 or 11 | 3 | 3 |
| 9 | 12 or 13 | 4 | 4 |
| 10 | 14 or more | 5 or more | 5 or more |

The above results confirm that, in the photoreceptors prepared in Examples 1 to 5, the occurrence of the minute line image defects is reduced compared with those prepared in Comparative Examples 1 and 3, and the occurrence of the color spots is reduced compared with those prepared in Comparative Examples 1 and 2.

The abbreviation used in Tables 1 and 2 is described below.

The term "CT coating liquid" refers to the charge-transporting-layer-forming coating liquid.

The details of the charge-transporting material and the antioxidant used for forming the charge-transporting layer are described below.

The butadiene-based charge-transporting material: the compound represented by Structural Formula (CT1A) below The benzidine-based charge-transporting material: the compound represented by Structural Formula (CT2A) below The hindered phenol antioxidant: the compound represented by Structural Formula (HP-1) below (CT1A)

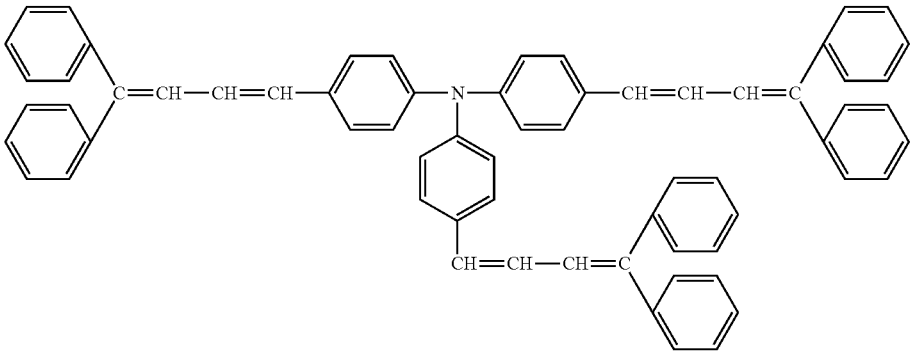

-continued (CT2A)

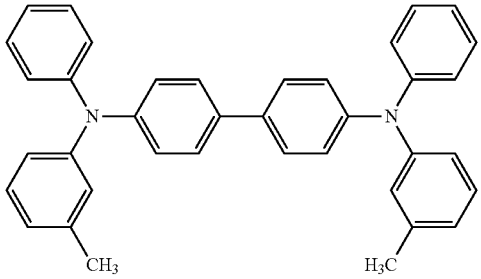

(HP-1)

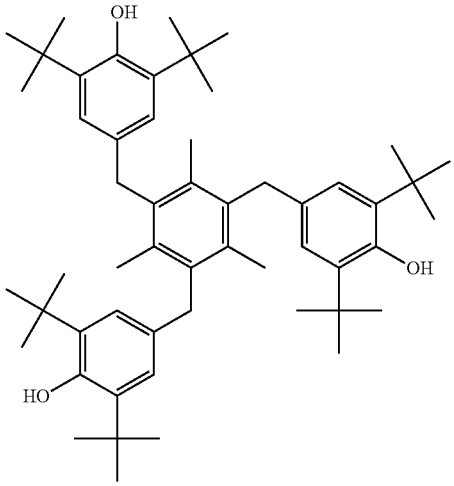

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor comprising:

a conductive support including a surface having an arithmetic average roughness $Ra_1$ of 0.3 μm or more and 1.0 μm or less, an average length RSm of a roughness profile curve element of the surface in an axial direction of the conductive support being 400 μm or less; and a photosensitive layer disposed on the conductive support, the photosensitive layer including a surface having an arithmetic average roughness $Ra_2$ of 0.05 μm or more and 0.8 μm or less.

2. The electrophotographic photoreceptor according to claim 1, wherein the arithmetic average roughness $Ra_1$ is 0.3 μm or more and 0.75 μm or less.

3. The electrophotographic photoreceptor according to claim 1, wherein the arithmetic average roughness $Ra_1$ is 0.3 μm or more and 0.6 μm or less.

4. The electrophotographic photoreceptor according to claim 1, wherein the arithmetic average roughness $Ra_2$ is 0.05 μm or more and 0.6 μm or less.

5. The electrophotographic photoreceptor according to claim 1, wherein the average length RSm of the roughness profile curve element is 250 μm or less.

6. The electrophotographic photoreceptor according to claim 1, wherein the conductive support has a thickness of 0.25 mm or more and 1.0 mm or less.

7. The electrophotographic photoreceptor according to claim 1, wherein the conductive support is a machined pipe having a thickness of 0.25 mm or more and 1.0 mm or less.

8. The electrophotographic photoreceptor according to claim 1, wherein the conductive support is a machined pipe having a thickness of 0.25 mm or more and 0.75 mm or less.

9. The electrophotographic photoreceptor according to claim 1, wherein the conductive support is an impact-pressed pipe having a thickness of 0.25 mm or more and 0.8 mm or less.

10. The electrophotographic photoreceptor according to claim 1, wherein the conductive support is an impact-pressed pipe having a thickness of 0.4 mm or more and 0.7 mm or less.

11. A process cartridge detachably attachable to an image-forming apparatus, the process cartridge comprising:

the electrophotographic photoreceptor according to claim 1; and a charging unit that charges a surface of the electrophotographic photoreceptor by contact charging in which only a direct voltage is applied to the surface of the electrophotographic photoreceptor.

12. An image-forming apparatus comprising:

the electrophotographic photoreceptor according to claim 1;

a charging unit that charges a surface of the electrophotographic photoreceptor by contact charging in which only a direct voltage is applied to the surface of the electrophotographic photoreceptor;

an electrostatic-latent-image-forming unit that forms an electrostatic latent image on the charged surface of the electrophotographic photoreceptor;

a developing unit that develops the electrostatic latent image formed on the surface of the electrophotographic photoreceptor with a developer including a toner in order to form a toner image; and a transfer unit that transfers the toner image onto a surface of a recording medium.

* * * * *